US009412543B2

(12) United States Patent
Lammers

(10) Patent No.: US 9,412,543 B2
(45) Date of Patent: Aug. 9, 2016

(54) ARC ENERGY ABSORBER

(71) Applicant: Arend Lammers, TV Hengelo (NL)

(72) Inventor: Arend Lammers, TV Hengelo (NL)

(73) Assignee: EATON INDUSTRIES (NETHERLANDS) B.V., Hengelo (NL)

( * ) Notice: Subject to any disclaimer, the term of this patent is extended or adjusted under 35 U.S.C. 154(b) by 0 days.

(21) Appl. No.: 14/360,938

(22) PCT Filed: Nov. 27, 2012

(86) PCT No.: PCT/EP2012/073676

§ 371 (c)(1),
(2) Date: May 28, 2014

(87) PCT Pub. No.: WO2013/079464

PCT Pub. Date: Jun. 6, 2013

(65) Prior Publication Data

US 2014/0319100 A1 Oct. 30, 2014

(30) Foreign Application Priority Data

Nov. 28, 2011 (EP) ..... 11190985

(51) Int. Cl.
*H01H 33/76* (2006.01)
*H01H 9/30* (2006.01)
*H01H 9/34* (2006.01)

(52) U.S. Cl.
CPC ..... *H01H 33/76* (2013.01); *H01H 9/302* (2013.01); *H01H 9/342* (2013.01); *H01H 2213/00* (2013.01)

(58) Field of Classification Search
CPC ..... H01H 9/52; H01H 73/18; H01H 33/76; H01H 33/58; H01H 2033/568; H01H 9/302; H01H 9/342; H02B 13/025
USPC ..... 218/157, 158, 155, 85, 150; 361/676
See application file for complete search history.

(56) References Cited

U.S. PATENT DOCUMENTS

| | | | | |
|---|---|---|---|---|
| 2,236,580 | A | 4/1941 | Sandin et al. | |
| 3,192,347 | A * | 6/1965 | Stringfellow et al. | 218/150 |
| 5,457,296 | A * | 10/1995 | Neill et al. | 200/306 |
| 5,828,026 | A * | 10/1998 | Bruhl et al. | 218/150 |
| 7,586,058 | B2 * | 9/2009 | Kozar | H01H 9/342 218/157 |
| 7,598,833 | B1 * | 10/2009 | Hodges | H01H 9/342 335/201 |
| 2008/0237194 | A1 * | 10/2008 | Moore et al. | 218/158 |
| 2009/0141432 | A1 | 6/2009 | Kingston | |

FOREIGN PATENT DOCUMENTS

| | | | | |
|---|---|---|---|---|
| CH | 453447 | A | 6/1958 | |
| DE | 19520698 | * | 12/1996 | H02B 13/025 |
| EP | 0098308 | A1 | 1/1984 | |
| EP | 1450458 | A1 | 8/2004 | |

OTHER PUBLICATIONS

Machine translation of DE19520698 attached to OA.*

* cited by examiner

*Primary Examiner* — Renee S Luebke
*Assistant Examiner* — William Bolton
(74) *Attorney, Agent, or Firm* — Leydig, Voit & Mayer, Ltd.

(57) ABSTRACT

A device for cooling exhaust gases caused by an electrical arc in high or medium voltage switch gear, which device comprises a housing with an inlet and an outlet for passage of the gases, wherein a hydrous mineral is arranged in the housing for cooling the gases with the water contained in the hydrous mineral.

14 Claims, 2 Drawing Sheets

ARC ENERGY ABSORBER

CROSS-REFERENCE TO RELATED APPLICATIONS

This application is a U.S. National Stage Application under 35 U.S.C. §371 of International Application No. PCT/EP2012/073676 filed on Nov. 27, 2012, and claims benefit to European Patent Application No. EP 11190985.9 filed on Nov. 28, 2011. The International Application was published in English on Jun. 6, 2013, as WO 2013/079464 A1 under PCT Article 21(2).

FIELD

The invention relates to a device for cooling exhaust gases caused by an electrical arc in high or medium voltage switch gear, which device comprises a housing with an inlet and an outlet for passage of the gases.

BACKGROUND

With high and medium voltage switch gear an accidental internal arc could occur. Such an arc is of high power and causes gases of high temperatures and a sudden increase in pressure in the housing for the switch gear. To relieve the pressure, a typical switch gear is usually provided with a blowout panel, which folds open by the high pressure of the arc.

If no other means are provided, then the hot gases would be blown out of the switch gear housing. In order to avoid damages to other objects and persons around the switch gear housing, sometimes an arc absorber is arranged in front of the blowout panel. Such an arc absorber contains ceramic elements with a plurality of parallel channels, through which the hot gases flow. Due to the large contact surface in the ceramic elements, heat of the gases is transferred into the ceramic elements, reducing the heat of the gases. Such a device for cooling exhaust gases is for example known from EP 1450458.

To have a sufficient cooling capacity with such ceramic elements a substantial length is required along which the gases are guided.

US 2009141432 describes a device for cooling hot gases caused by an accidental electric arc, which device has a number of plate like elements stacked together and spaced apart. The hot gases are guided through the channels between the elements.

The elements are provided with a layer of phase change material, like a metallic salt. When the metallic salt is heated by the hot gases, it will change phase from a solid state to a gas state. This phase change of the metallic salt will extract heat from the hot gases resulting in cooled gas.

Such a device is difficult to manufacture and it is difficult to ensure a good contact between the phase change material and the hot gases.

SUMMARY

An aspect of the invention provides a device for cooling one or more exhaust gases caused by an electrical arc in a high or medium voltage switch gear, the device comprising: a housing comprising an inlet and an outlet configured to allow passage of the exhaust gases; and a hydrous mineral comprising water, wherein the hydrous mineral is arranged in the housing, and wherein the hydrous mineral is suitable for cooling the exhaust gases with the water comprised in the hydrous mineral.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
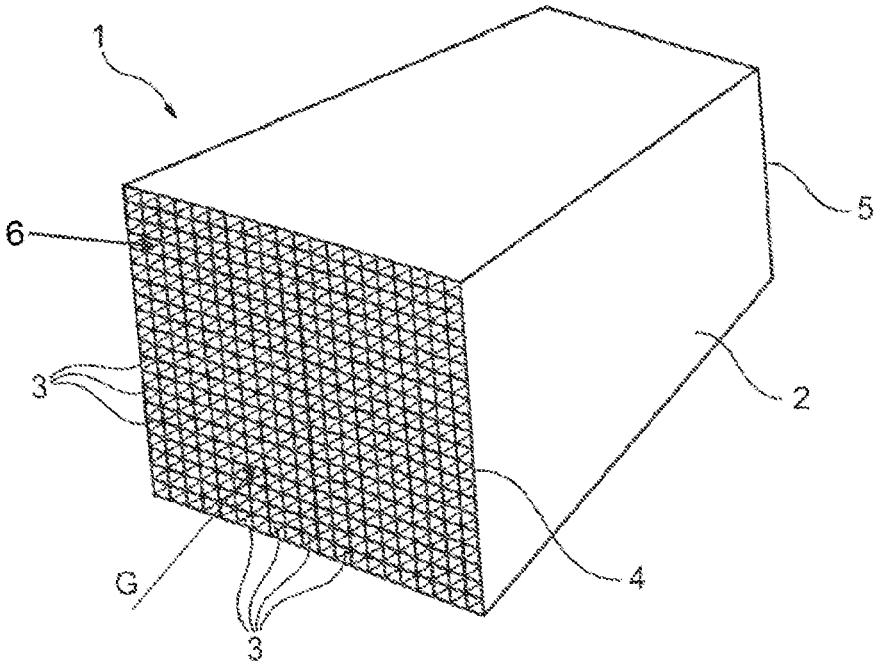
FIG. 1 shows a perspective view of a first embodiment of a device according to the invention.

In a device according to the invention a hydrous mineral is arranged in the housing for cooling the gases with the water contained in the hydrous mineral.

Hydrous minerals are minerals containing water in their structure. The water is maintained in the mineral in the true structure of $H_2O$. By heating the hydrous mineral, the water is forced out of the mineral and is freed to cool the gases of the accidental electric arc.

By using hydrous minerals a substantial amount of water can be maintained in the device, which is only released when necessary. The water has a substantial heat capacity, such that with a relative small housing comprising the hydrous mineral, a substantial heat capacity is provided for cooling the hot gases.

In a preferred embodiment of the device according to the invention the hydrous mineral is gypsum.

Gypsum is a typical low cost hydrous mineral, which can easily be used for a device according to the invention. The chemical formula of gypsum tells that two water molecules are bound to each molecule of calcium sulfate ($CaSO_4.2H_2O$). Because it contains water as a specific number of water molecules, gypsum is classified as a hydrous mineral, or hydrate. The water in the gypsum is not simply absorbed, but is chemically bonded into the atomic structure of the calcium-sulfate lattice. Thus, the water is not bonded as separate oxygen and hydrogen ions, but as integral water molecules that retain their characteristic composition and structure.

So, when the gypsum is heated to generally a temperature of above 150 degrees Celsius, the water molecules are forced out of the calcium-sulfate lattice. This freed water is then used for cooling the hot gases.

In a preferred embodiment of the device according to the invention at least one element having a plurality of channels, through which the exhaust gases are fed, is arranged in the housing and wherein the element comprises the hydrous mineral.

Such an element with a plurality of channels has the advantage of a large contact surface in a relative small element. Furthermore, these elements according to the invention could easily be used in housings according to the prior art as a replacement for the ceramic elements.

Preferably the at least one element is a rectangular cuboid and the plurality of channels are parallel and extend from one side of the cuboid to the opposite side. A rectangular cuboid is easy to stack together to provide a composed element with a desired heat capacity.

The element could be monolithic. The elements could for example be extruded from gypsum, similar to the manufacture of the ceramic elements.

In yet another preferred embodiment of the device according to the invention the housing is filled with hydrous mineral pellets. Pellets are easily made and a housing can simply be filled with the pellets by pouring the elements in the housing. Also, by filling the housing with pellets, it is ensured that a plurality of channels is obtained, through which the hot gases can flow. Furthermore, the pellets provide for a large contact surface.

The invention also relates to a switch gear housing for housing high or medium voltage electronic components, the housing comprising an outlet opening and a device for cooling exhaust gases according to the invention arranged in the outlet opening.

A preferred embodiment of the switch gear housing according to the invention, comprises a duct system arranged in the housing debouching in the outlet opening, wherein the device for cooling exhaust gases is arranged in the duct system.

The duct system ensures that the gases produced by an internal arc are guided to the outlet opening and thus through the device according to the invention.

In a further embodiment of the switch gear housing according to the invention the outlet opening is closed off by a blowout panel.

In FIG. 1 a device 1 according to the invention is shown. The device 1 has a monolithic housing 2 with a plurality of parallel channels 3 running from a first side 4 to the opposite side 5. The device 1 also includes gas cooling element 6 arranged in the monolithic housing 2. The device 1 is preferably made of gypsum for example by extrusion. When hot gases G are guided through the channels 3, heat is exchanged with the gypsum, such that water is freed, which will cool the hot gases.

Figure 2:
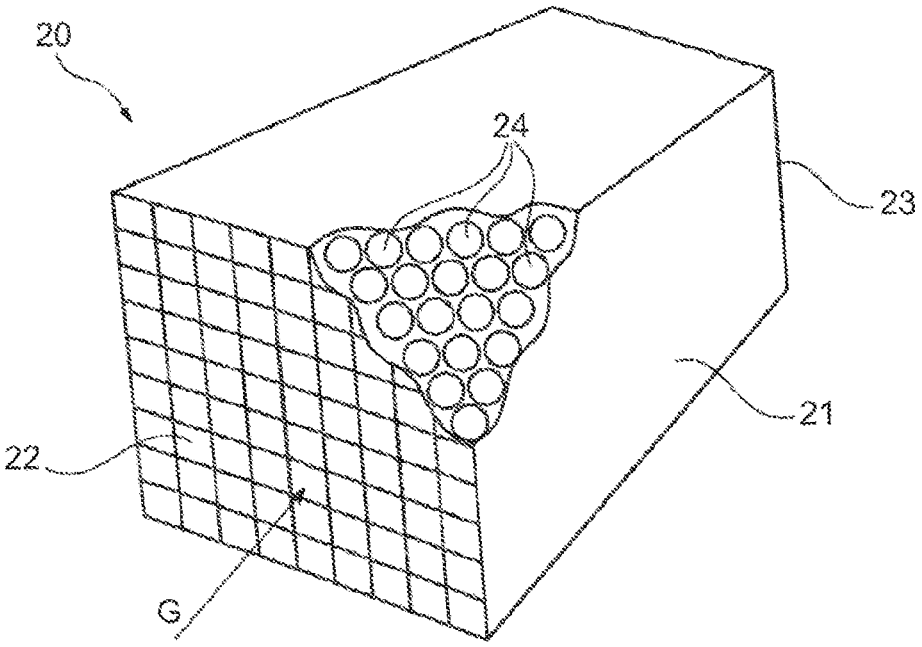
FIG. 2 shows a perspective view of a second embodiment of a device according to the invention.

FIG. 2 shows a second embodiment 20 of a device according to the invention. This device 20 has a housing 21 with a grating 22 in the front side and a grating 23 on the opposite back side. The housing 21 is furthermore filled with pellets 24 of a hydrous mineral, preferably gypsum.

Hot gas G enters the front grating 22 and swirls between the pellets 24, such that heat is exchanged with the pellets 24 and water is freed to cool the hot gases G.

Figure 3:
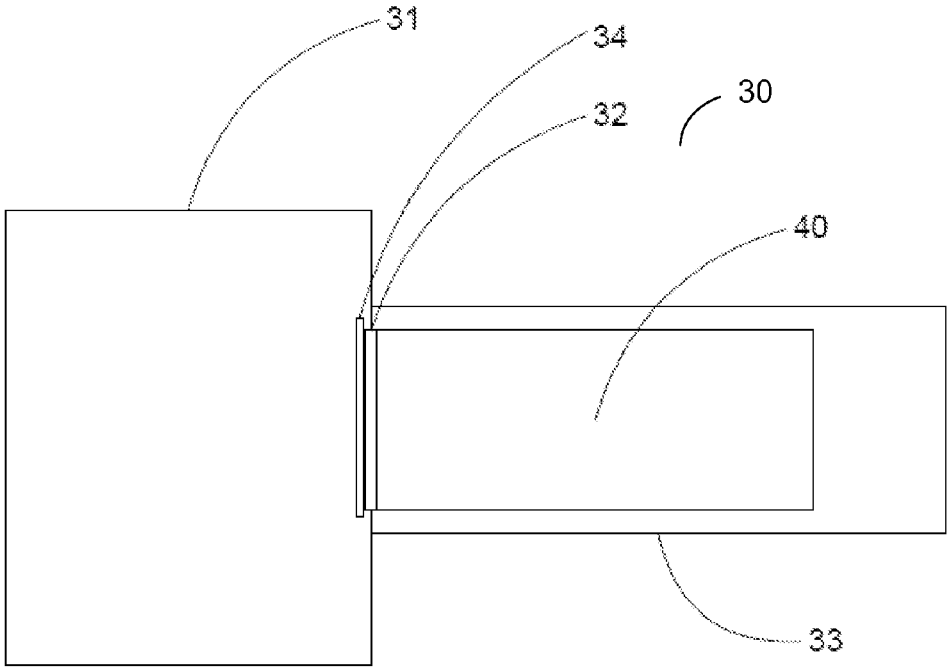
FIG. 3 shows a schematic view of a third embodiment of a device according to the invention.

FIG. 3 shows a third embodiment 30 of a device according to the invention. This device 30 has a switch gear housing 31 for housing high or medium voltage electronic components, the switch gear housing 31 comprising an outlet opening 32 and a cooling device 40 for cooling exhaust gases according to the invention arranged in the outlet opening 32. This device 30 also has a duct system 33 debouching in the outlet opening 32, which is closed off by a blowout panel 34. The cooling device 40 for cooling exhaust gases is arranged in the duct system.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A device for cooling one or more exhaust gases caused by an electrical are in a high or medium voltage switch gear, the device comprising:

a device housing arranged in an outlet opening of a switch gear housing of a high or medium voltage switch gear, the device housing comprising an inlet and an outlet configured to allow passage of the exhaust gases; and a gas cooling element arranged between the inlet and the outlet filled with a plurality of hydrous mineral pellets comprising water, wherein the hydrous mineral is suitable for cooling the exhaust gases with the water comprised in the hydrous mineral.

2. The device of claim 1, wherein the hydrous mineral comprises gypsum.

3. The device of claim 1, wherein the gas cooling element comprises a plurality of channels formed by the plurality of hydrous mineral pellets through which the exhaust gases are fed.

4. The device of claim 3, wherein the gas cooling element is a rectangular cuboid, and wherein the plurality of channels are parallel and extend from one side of the cuboid to the opposite side.

5. The device of claim 3, wherein the gas cooling element is monolithic.

6. The device of claim 1, wherein a duct system is arranged in the switch gear housing, the duct system debouching in the outlet opening, wherein the device is arranged in the duct system.

7. The device of claim 1, wherein the outlet opening is closed off by a blowout panel.

8. The device of claim 1, wherein the hydrous mineral comprises calcium.

9. The device of claim 1, wherein the hydrous mineral comprises a calcium cation.

10. The device of claim 1, wherein the hydrous mineral comprises a calcium cation and a sulfur oxide anion.

11. The device of claim 1, wherein the hydrous mineral comprises sulfate.

12. The device of claim 1, wherein the hydrous mineral comprises $CaSO_4$.

13. The device of claim 1, wherein the hydrous mineral consists essentially of gypsum.

14. The device of claim 1, further comprising a front side grating disposed at the inlet of the device housing and a back side grating disposed at the outlet of the device housing.

* * * * *